US007798811B2

(12) United States Patent
Nitadori et al.

(10) Patent No.: US 7,798,811 B2
(45) Date of Patent: Sep. 21, 2010

(54) VERTICAL TYPE HEAT PROCESSING APPARATUS AND VERTICAL TYPE HEATING METHOD

(75) Inventors: Hiromi Nitadori, Oshu (JP); Hirofumi Kaneko, Oshu (JP)

(73) Assignee: Tokyo Electron Limited, Tokyo (JP)

( * ) Notice: Subject to any disclaimer, the term of this patent is extended or adjusted under 35 U.S.C. 154(b) by 439 days.

(21) Appl. No.: 12/000,678

(22) Filed: Dec. 14, 2007

(65) Prior Publication Data

US 2008/0153049 A1 Jun. 26, 2008

(30) Foreign Application Priority Data

Dec. 22, 2006 (JP) ..... 2006-346362

(51) Int. Cl.
*F27D 3/12* (2006.01)

(52) U.S. Cl. ..... 432/241; 219/392; 432/5

(58) Field of Classification Search ..... 432/5, 432/239, 241, 247; 219/209, 392; 438/715, 438/716

See application file for complete search history.

(56) References Cited

U.S. PATENT DOCUMENTS 5,055,036 A * 10/1991 Asano et al. ..... 432/5
5,829,969 A * 11/1998 Miyashita et al. ..... 432/253
5,857,848 A * 1/1999 Takahashi et al. ..... 432/253
6,042,372 A * 3/2000 Sakata et al. ..... 432/241
6,164,963 A * 12/2000 Weaver ..... 432/241
6,318,944 B1 * 11/2001 Shimeno et al. ..... 414/172
6,573,198 B2 * 6/2003 Boonstra et al. ..... 438/795
2001/0016307 A1 * 8/2001 Ishii ..... 432/239
2003/0068219 A1 * 4/2003 Boonstra et al. ..... 414/935
2009/0269933 A1 * 10/2009 Yamaguchi et al. ..... 438/706

* cited by examiner

*Primary Examiner*—Gregory A Wilson
(74) *Attorney, Agent, or Firm*—Smith, Gambrell & Russell, LLP

(57) ABSTRACT

A vertical type heat processing apparatus prevents falling-down of a boat placed on a heat insulating mount due to an external force, such as an earthquake. The apparatus includes a heating furnace having a furnace port, a cover, a pair of substrate holding tools, each to be placed on the cover via a heat insulating mount and to hold multiple substrates, a rotating mechanism, and a lifting mechanism to raise and lower the cover to carry in and carry out the substrate holding tool relative to the furnace. While one of the substrate holding tools is located in the furnace, the other is placed on a table, for loading the substrates. Each substrate holding tool is carried between the table and the heat insulating mount due to a carrier mechanism. Further, a locking part and a part to be locked can be engaged with each other.

9 Claims, 10 Drawing Sheets

VERTICAL TYPE HEAT PROCESSING APPARATUS AND VERTICAL TYPE HEATING METHOD

CROSS REFERENCE TO RELATED APPLICATIONS

This application is based upon the prior Japanese Patent Application No. 2006-346362 filed on Dec. 22, 2006, the entire contents of which are incorporated herein by reference.

BACKGROUND OF THE INVENTION

1. Field of the Invention

The present invention relates to a vertical type heat processing apparatus and a vertical type heating method.

2. Background Art

In the manufacture of semiconductor wafers, various processes including oxidation, film forming and the like, are provided to each semiconductor wafer (substrate), and, for example, a vertical type heat processing apparatus (or semiconductor manufacturing apparatus), in which multiple sheets of wafers can be processed in a batch-type manner, has been employed as an apparatus for performing such processes (e.g., see Patent Document 1 (TOKKYO No. 3378241, KOHO)). The vertical type heat processing apparatus includes a loading area (transfer area) below a vertical type heating furnace having a furnace port at a bottom portion. In the loading area, a boat (or substrate holding tool) is mounted on a cover adapted to open and close the furnace port, via a heat insulating mount. The boat serves to receive and hold, therein, multiple sheets (e.g., 100 to 150 sheets) of wafers each having a large size, for example, a 300 mm diameter. In addition, a lifting mechanism for carrying in and carrying out the boat relative to the heating furnace by raising and lowering the cover, and a loading mechanism for loading or transferring the wafers between the boat and a carrier (or container) containing the plurality of wafers therein are also provided in the loading area.

The boat is made from quartz, which is quite expensive. The wafers are also expensive, thus the production cost will be more increased with further progress of the processing steps. Accordingly, handling of these components or materials must be carried out with greater care.

However, in the batch-type semiconductor manufacturing apparatus described above, the construction of the apparatus poses various restrictions on the conditions for the software and hardware, as such making it difficult to render the apparatus better suited for an earthquake resistant construction or earthquake-proof function, thus being currently insufficient against earthquake problems. Therefore, when an earthquake occurs and the apparatus experiences a greater shake, fall down of the boat and serious breakdown of the boat and wafers may tend to be caused, leading to drastic damage.

To address these problems, in the vertical type heat processing apparatus described in the Patent Document 1 (TOKKYO No. 3378241, KOHO), a structure for connecting and fixing a bottom plate of the substrate holding tool and the heat insulating mount to each other by using a substrate holding tool fixing member is employed.

In the vertical type heat processing apparatuses, those employing the so-called two-boat system have been known. In each of such apparatuses, two boats are employed, such that while one of the boats is carried into the heating furnace and subjected to a heating process, the other boat can be used for loading semiconductor wafers therein.

However, in the vertical type heat processing apparatus employing such a two-boat system, the change of the boats on the heat insulating mount should make it difficult to employ the structure for connecting and fixing the substrate holding tool to the heat insulating mount by using the substrate holding tool fixing member. Thus, there is a risk that the boat on the heat insulating mount may take a fall when receiving an external force, such as an earthquake or the like. Meanwhile, as the type not including the heat insulating mount on the cover, those having a structure including a locking member capable of engaging and disengaging a mounting portion on the cover relative to the substrate holding tool due to rotation of the locking member and a rotating part for rotating the locking member have been proposed (see Patent Document 2 (TOKUKAI No. 2003-258063, KOHO)). However, such a structure requires the rotating part for rotating the locking member, in addition to a rotating mechanism for rotating the substrate holding tool, thus inevitably complicating the structure and rendering itself inapplicable to those including the heat insulating mount.

SUMMARY OF THE INVENTION

The present invention was made in view of the above circumstances, and it is therefore an object thereof to provide a vertical type heat processing apparatus and a vertical type heating method, which can prevent the fall down of the boat on the cover due to an external force, such as an earthquake or the like, by employing a simple structure, while taking a form of the two-boat system.

The present invention is a vertical type heat processing apparatus, comprising: a heating furnace having a furnace port formed at a bottom portion thereof; a pair of substrate holding tools each adapted to hold multiple substrates and configured to be carried into the heating furnace so as to perform a heating process to the substrates; a cover adapted to close the furnace port of the heating furnace; a heat insulating mount provided on the cover; a rotating mechanism provided to the cover and adapted to rotate the cover and the heat insulating mount; a lifting mechanism adapted to raise and lower the cover; a table provided adjacent to a position just below the heating furnace; and a carrier mechanism adapted to carry each of the pair of substrate holding tools between a position on the heat insulating mount and a position on the table, wherein a locking part is proved to either one of each substrate holding tool and the heat insulating mount, and a part to be locked is provided to the other thereof, such that the locking part and the part to be locked can be engaged with and disengaged from each other, by rotating the heat insulating mount due to the rotating mechanism, while each substrate holding tool is held just above the heat insulating mount due to the carrier mechanism.

The present invention is the vertical type heat processing apparatus described above, wherein each substrate holding tool has an annular bottom plate, and the heat insulating mount includes a plurality of columns with an appropriate interval, each adapted to support a bottom face of the bottom plate, along its circumferential direction, and wherein the part to be locked is formed in an outer side face of each column so as to be of a groove-like shape, and the locking part is formed at the bottom face of the bottom plate so as to have an L-shape, such that the locking part can be engaged with each part to be locked.

The present invention is the vertical type heat processing apparatus described above, wherein the rotating mechanism includes a sensor for detecting a point of the origin in the rotating direction of the heat insulating mount, and a control unit for controlling the rotation of the heat insulating mount such that the heat insulating mount will be in a position for enabling the engagement or in a position for enabling the disengagement, between each locking part and each part to be locked, based on a signal to be detected from the sensor.

The present invention is the vertical type heat processing apparatus described above, wherein the locking part is provided to the heat insulating mount, the locking part having an elliptic-plate-like shape projecting upward from a central portion of a top end of the heat insulating mount and extending in the lateral direction, and wherein each substrate holding tool has a bottom plate capable of being mounted on the top end of the heat insulating mount, and a key hole, through which the locking part can be inserted, is formed in the bottom plate, such that the top face of the bottom plate opposed to the locking part can serve as the part to be locked, thereby to be engaged with the locking part, by rotating the locking part having been inserted through the key hole, over a predetermined angle, together with the heat insulating mount.

The present invention is the vertical type heat processing apparatus described above, wherein each substrate holding tool has an annular bottom plate, and the heat insulating mount has a plurality of columns with an appropriate interval, each adapted to support the bottom face of the bottom plate, along the circumferential direction, and wherein the part to be locked is composed of a female screw hole formed in an upper portion of each column, and the locking part is composed of an attaching screw configured to be inserted in the female screw hole from the bottom plate and fixedly engaged with the female screw.

The present invention is a vertical type heating method, comprising the steps of: placing one substrate holding tool holding multiple substrates, on a cover adapted to close a furnace port of a heating furnace, via a heat insulating mount; carrying the one substrate holding tool into the heating furnace, by elevating the cover by a lifting mechanism; performing a heating process to the substrates in the heating furnace while rotating the cover, the heat insulating mount and the substrate holding tool, by a rotating mechanism, as well as loading substrates onto the other substrate holding tool placed on a table; and carrying the one substrate holding tool from a position on the heat insulating mount onto the table while carrying the other substrate holding tool from a position on the table onto the heat insulating mount, wherein a locking part is provided to either one of each substrate holding tool and the heat insulating mount, while a part to be locked is provided to the other thereof, such that the locking part and the part to be locked can be engaged with each other, by rotating the heat insulating mount by the rotating mechanism, while the other substrate holding tool is held just above the heat insulating mount by a carrier mechanism, and thereafter the other substrate holding tool can be mounted on the heat insulating mount, by further lowering the other substrate holding tool.

The present invention is the vertical type heating method described above, wherein each substrate holding tool has an annular bottom plate, and the heat insulating mount includes a plurality of columns with an appropriate interval, each adapted to support a bottom face of the bottom plate, along its circumferential direction, and wherein the part to be locked is formed in an outer side face of each column so as to have a groove-like shape, and the locking part is formed at the bottom face of the bottom plate so as to be of an L-shape, such that the locking part can be engaged with each part to be locked.

The present invention is the vertical type heating method described above, wherein the rotating mechanism includes a sensor for detecting a point of the origin in the rotating direction of the heat insulating mount, and a control unit for controlling the rotation of the heat insulating mount such that the heat insulating mount will be in a position for enabling the engagement or in a position for enabling the disengagement, between each locking part and each part to be locked, based on a signal to be detected from the sensor.

The present invention is the vertical type heating method described above, wherein the locking part is provided to the heat insulating mount, the locking part having an elliptic-plate-like shape projecting upward from a central portion of a top end of the heat insulating mount and extending in the lateral direction, and wherein each substrate holding tool has a bottom plate capable of being mounted on the top end of the heat insulating mount, and a key hole, through which the locking part can be inserted, is formed in the bottom plate, such that the top face of the bottom plate opposed to the locking part can serve as the part to be locked, thereby to be engaged with the locking part, by rotating the locking part having been inserted through the key hole, over a predetermined angle, together with the heat insulating mount.

Therefore, the apparatus and method according to the present invention, can securely prevent fall down of the boat placed on the heat insulating mount due to an external force, such as an earthquake, by employing a simple structure, while taking a form of the so-called two-boat system.

DETAILED DESCRIPTION OF THE INVENTION EXAMPLES

Figure 1:
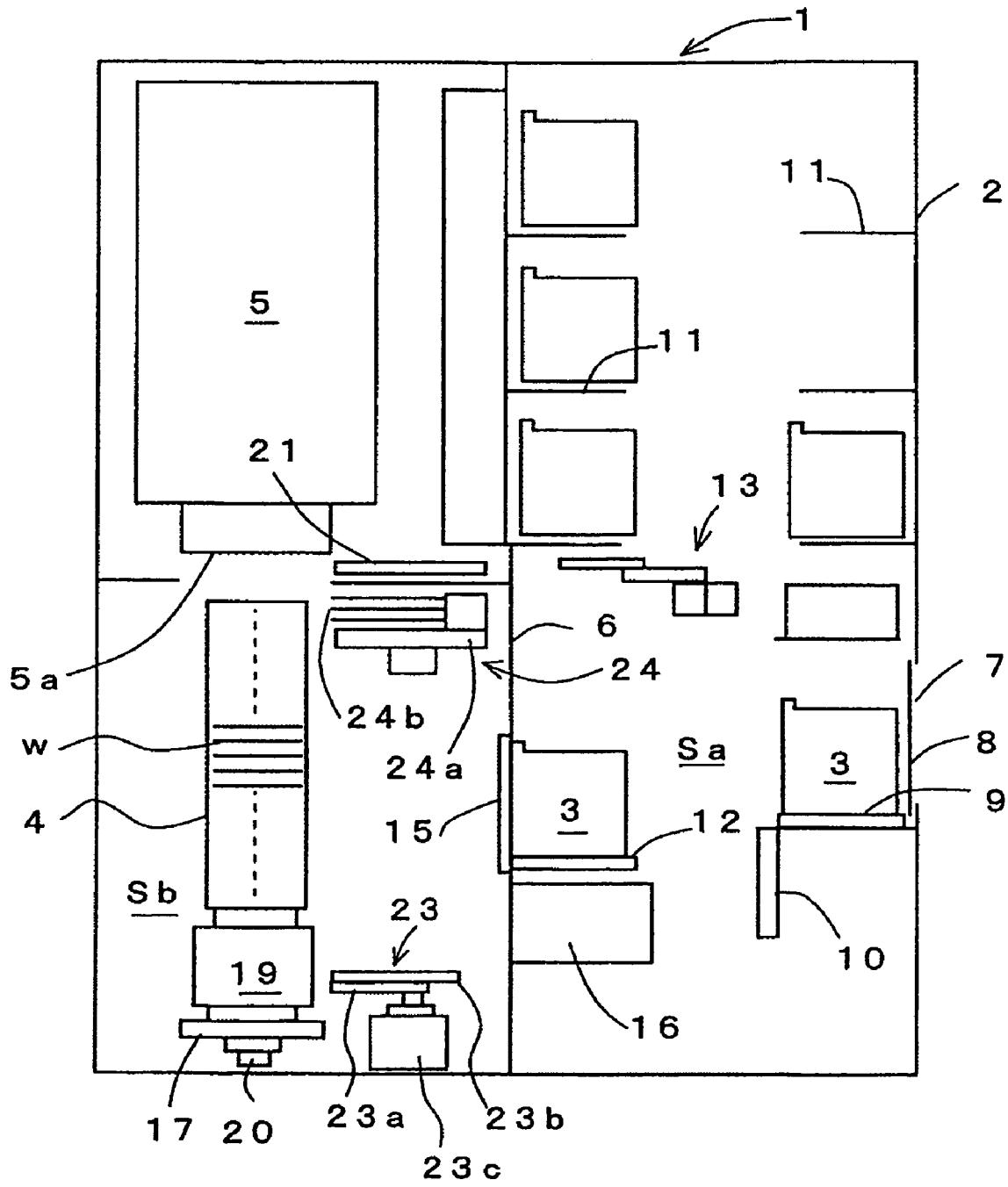
FIG. 1 is a longitudinal cross section schematically showing a vertical type heat processing apparatus according to one embodiment of the present invention.
Figure 2:
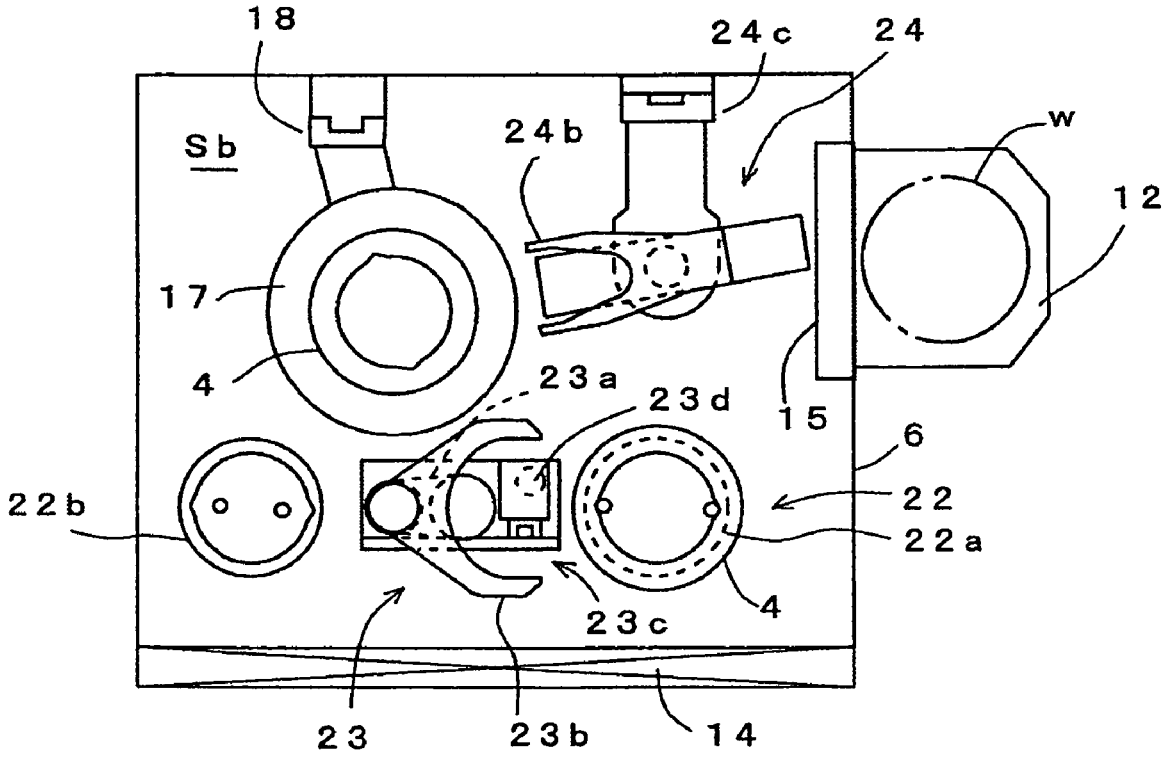
FIG. 2 is a plan view schematically showing a construction in a loading area of the vertical type heat processing apparatus.
Figure 3:
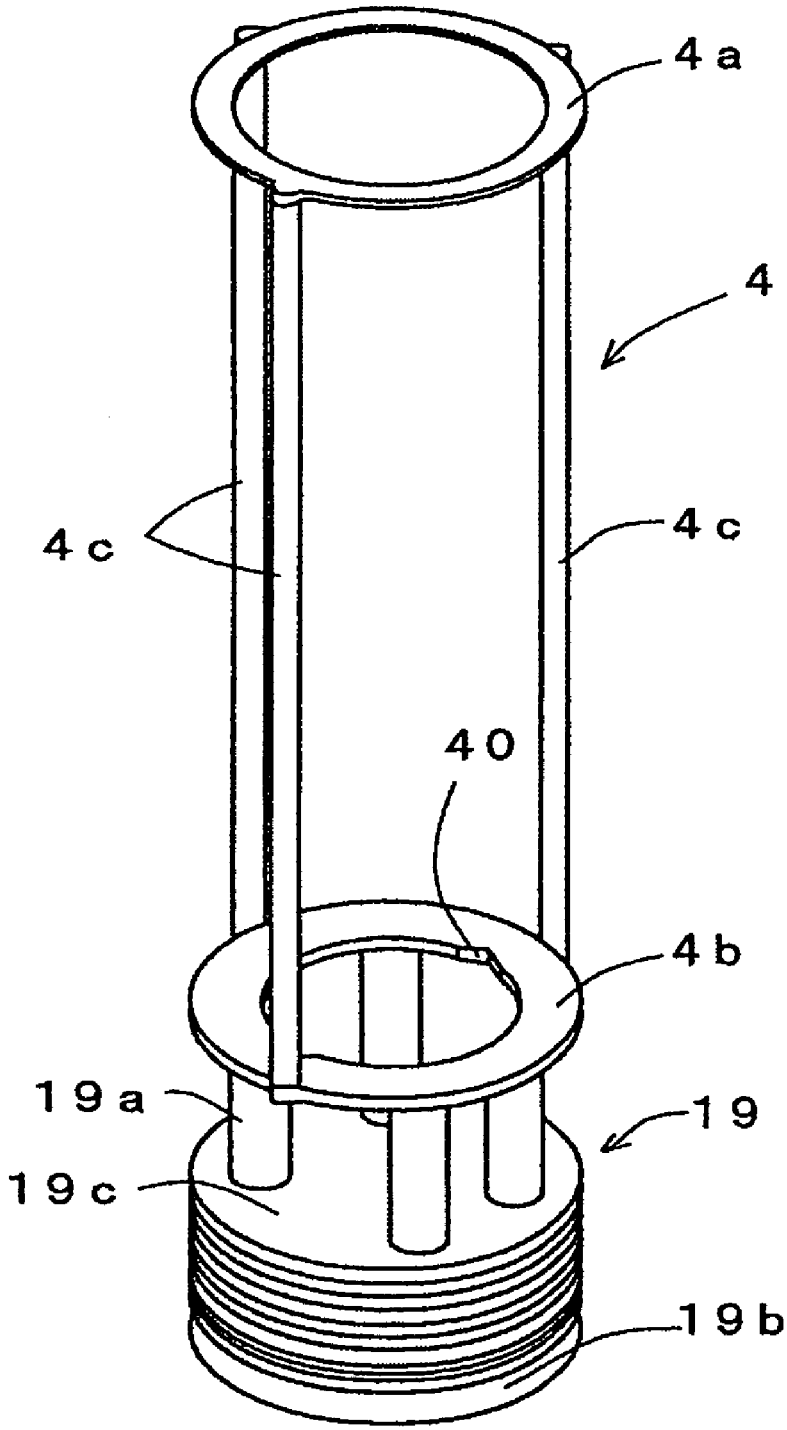
FIG. 3 is a perspective view schematically showing a state in which a wafer boat mounted on a heat insulating mount.
Figure 4:
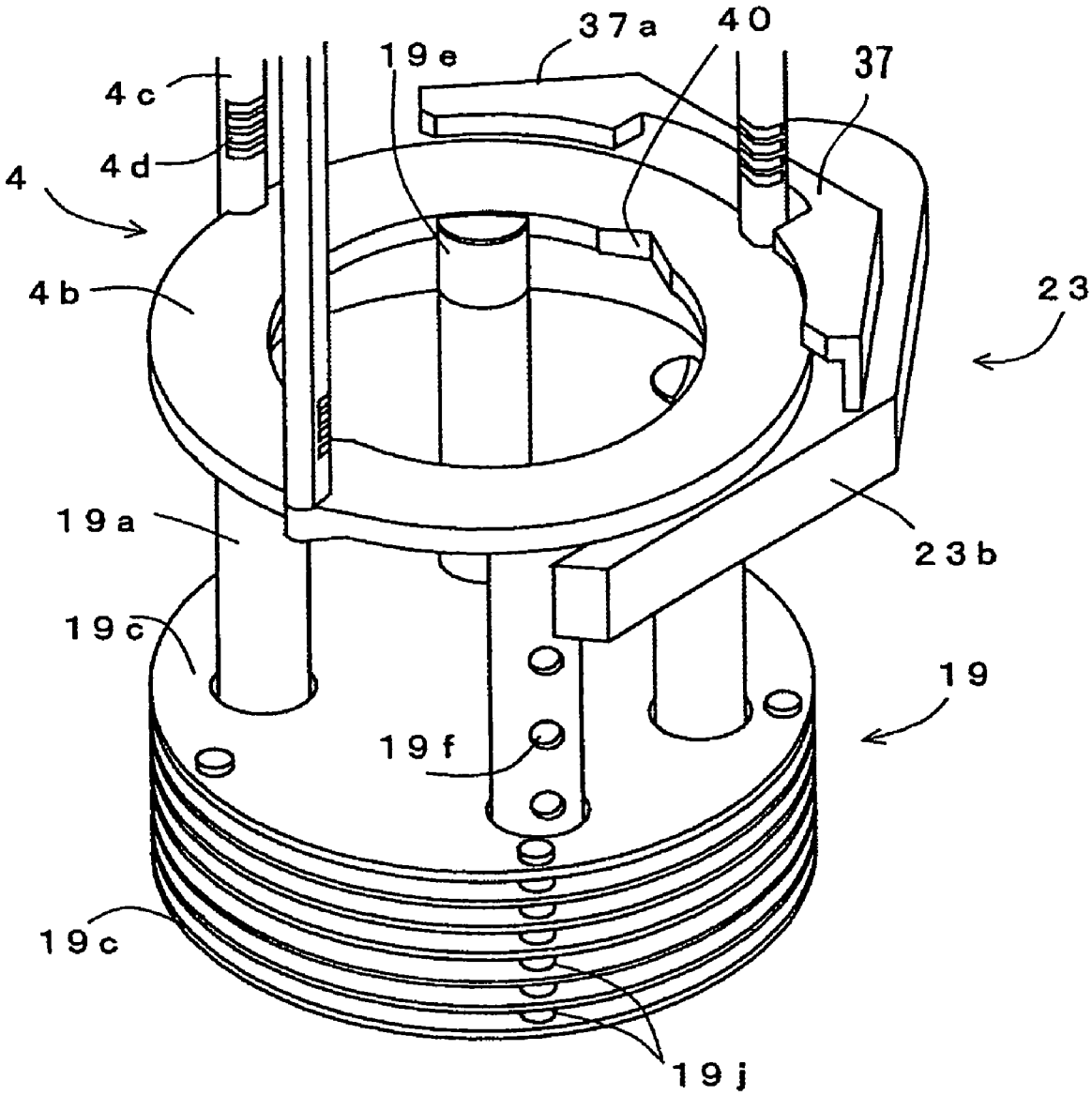
FIG. 4 is a perspective view showing a state in which the wafer boat is mounted on the heat insulating mount by using a carrier mechanism.
Figure 5:
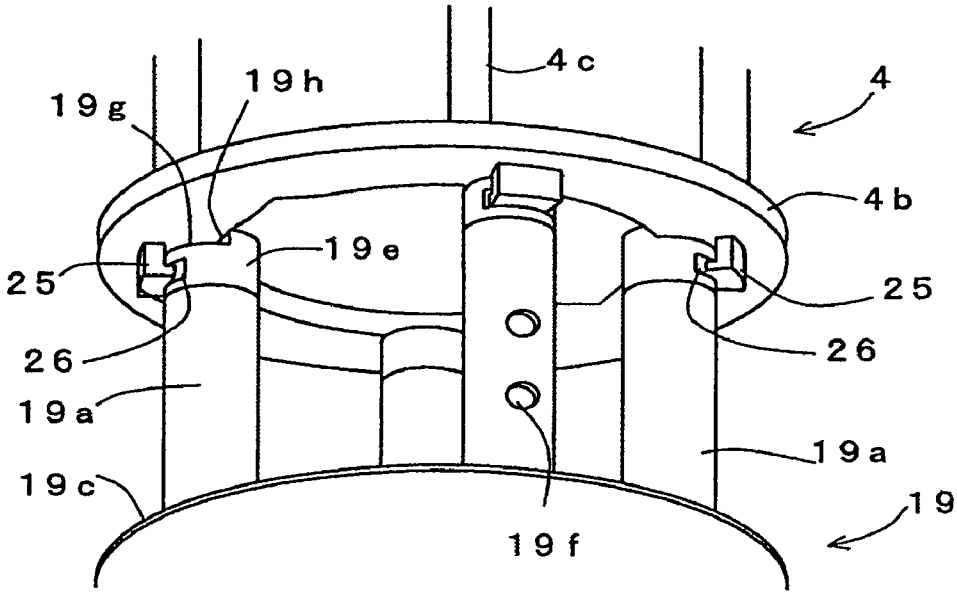
FIG. 5 is a perspective view showing a state in which a locking part and a part to be locked can be engaged with each other.
Figure 6:
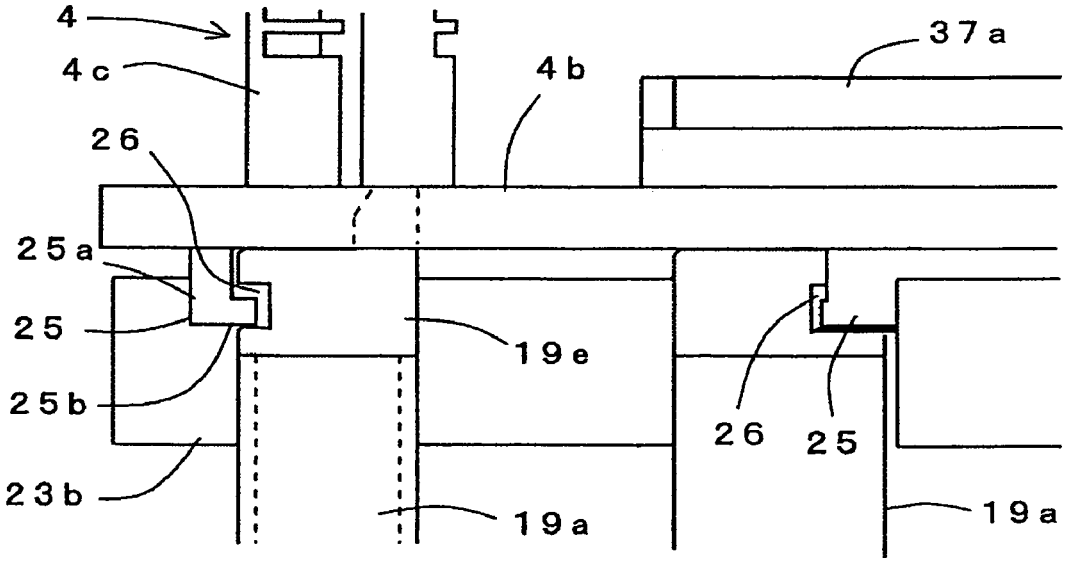
FIG. 6 is a view showing a state in which the wafer boat is mounted on the heat insulating mount.
Figure 7:
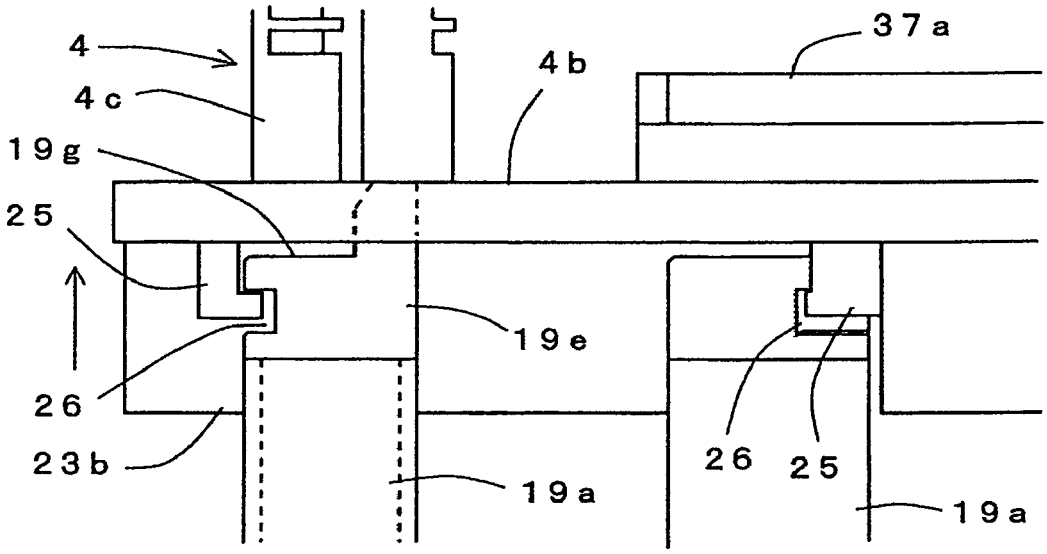
FIG. 7 is a diagram showing a state in which the wafer boat is elevated to a predetermined level upon carrying it from the heat insulating mount.
Figure 8:
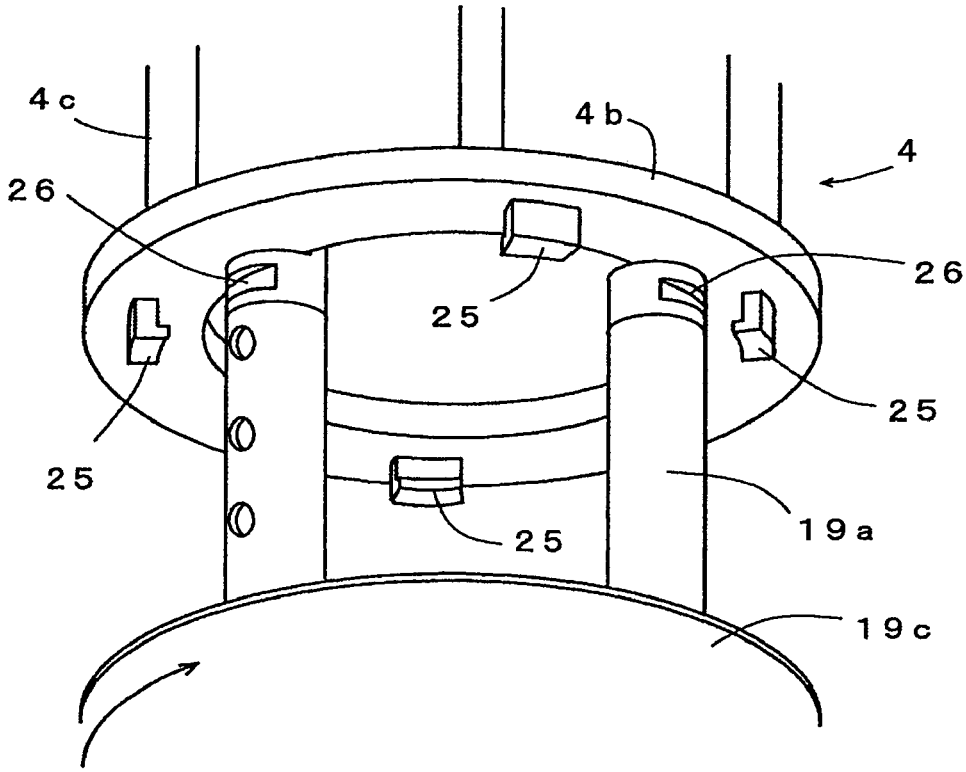
FIG. 8 is a perspective view showing a state in which the heat insulating mount is rotated to be disengaged from the wafer boat while wafer boat is elevated up to the predetermined level.
Figure 9:
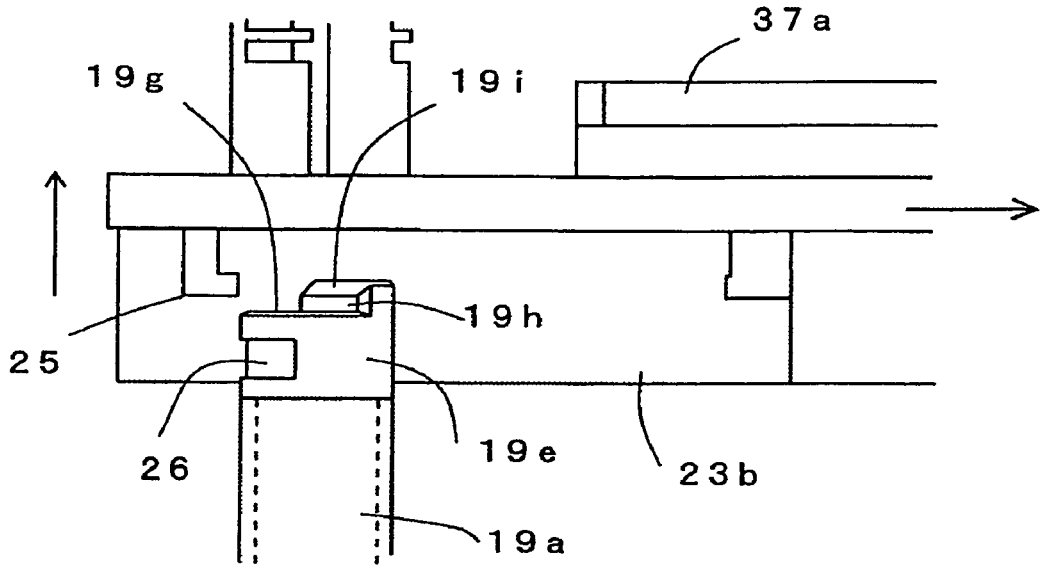
FIG. 9 is a view showing a state in which the wafer boat is further elevated up to a predetermined level from the heat insulating mount and then carried laterally.

Hereinafter, the present invention will be described, based on one embodiment that is currently considered as the best mode of this invention, with reference to the accompanying drawings. FIG. 1 is a longitudinal cross section schematically showing a vertical type heat processing apparatus according to the embodiment of the present invention, FIG. 2 is a plan view schematically showing a construction in a loading area of the vertical type heat processing apparatus, and FIG. 3 is a perspective view schematically showing a state in which a wafer boat mounted on a heat insulating mount. FIG. 4 is a perspective view showing a state in which the wafer boat is mounted on the heat insulating mount by using a carrier mechanism, and FIG. 5 is a perspective view showing a state in which a locking part and a part to be locked can be engaged with each other.

As shown in FIGS. 1 and 2, a semiconductor manufacturing apparatus, for example, a vertical-type heat processing apparatus 1, is installed in a clean room, and the heat processing apparatus 1 includes a housing 2 constituting an entire outer shell of the apparatus. In the housing 2, a carrying and storing area Sa for carrying and storing carriers (or containers) 3 each containing a plurality of semiconductor wafers (or substrates) W and a loading area Sb as a working area (or transferring area) are provided, and the carrying and storing area Sa is separated from the loading area Sb by a partition wall 6.

Additionally, a heating furnace 5 having a furnace port 5*a* formed at a bottom portion thereof and a pair of boats (or substrate holding tools) 4 each adapted to hold the plurality of wafers W therein and configured to be carried into the heating furnace 5 so as to provide a heating process to the wafers W are arranged in the housing 2.

Each boat 4 can hold multiple sheets, for example, about 100 to 150 sheets, of the wafers W therein, in the vertical direction, with a predetermined pitch. In the loading area Sb, a loading work for the wafers W can be performed between each boat 4 and each carrier 3, and works for carrying in and carrying out for each boat 4 can be performed relative to the heating furnace 5.

The furnace port 5*a* of the heating furnace 5 can be closed by a cover 17, and a heat insulating mount 19 is provided on the cover 17. Under the cover 17, a rotating mechanism 20 adapted to rotate the cover 17 together with the heat insulating mount 19 is provided. Additionally, a lifting mechanism 18 adapted to raise and lower the cover 17 is attached to the cover 17.

In the loading area Sb, a table 22 is provided adjacent to a position just below the heating furnace 5, such that each boat 4 can be carried between the heat insulating mount 19 and the table 22 by using a boat carrier mechanism 23.

Each carrier 3 is composed of a plastic container which can contain and carry multiple sheets, for example, about 13 to 25 sheets, of the wafers each having a predetermined size, for example, a 300 mm diameter, in a multistage fashion with a predetermined space, in the vertical direction, while holding each wafer arranged in the horizontal direction. Each carrier 3 has a cover (not shown) detachable thereto, the cover being adapted for airtightly closing a wafer taking out opening formed in a front face of the carrier 3.

A transfer port 7 is provided in a front face portion of the housing 2, for carrying in and carrying out the carrier 3, by an operator or actuation of a carrier robot. To the transfer port 7, a door 8 is provided, such that it can be slidably opened and closed in the vertical direction. In the carrying and storing area Sa, a table 9 is provided for supporting each carrier 3 thereon in the vicinity of the transfer port 7, and a sensor mechanism 10, for detecting, each position and the number of sheets, of the wafers W, by opening the cover of the carrier 3, is provided behind the table 9. Above the table 9 and at an upper portion of the partition wall 6, storing shelves 11 are provided for storing the plurality of carriers 3.

A loading stage 12 is provided at the partition wall 6 in the loading and storing area Sa, and the stage 12 is for supporting each carrier 3 thereon, for preparing the loading of the wafers. A carrier mechanism 13, for carrying each carrier 3 among the table 9, storing shelves 11 and loading stage 12, is provided in the carrying and storing area Sa.

The carrying and storing area Sa has an atmosphere cleaned by a fan filter unit (not shown). The loading area Sb is also cleaned by a fan filter unit 14 provided on one side thereof and is kept under a positive pressure atmospheric condition or in an inert gas atmosphere (for example, consisting of $N_2$ gas). In the partition wall 6, an opening (not shown) is formed for bringing the internal space of each carrier 3 into communication with the internal space of the loading area Sb, by keeping the front face of each carrier 3 placed on the loading stage 12 be in contact with the opening, from the side of the carrying and storing area Sa. A door 15 is provided to open and close the opening of the partition wall 6, from the side of the loading area Sb. The opening provided in the partition wall 6 is formed to have a substantially the same size of the opening of the carrier 3, such that the wafers can be taken in and taken out from the carrier 3 via the opening.

To the door 15 described above, a cover opening and closing mechanism (not shown) for opening and closing the cover of each carrier 3 and a door opening and closing mechanism (not shown) for opening and closing the door 15, from the side of the loading area Sb, are provided. By the cover opening and closing mechanism and the door opening and closing mechanism, the cover and the door 15 can be respectively moved to open toward the loading area Sb. In this case, the cover and the door 15 are respectively configured such that they can be shifted (or retracted) upward or downward to avoid being interference with the loading of the wafers. Below the loading stage 12, a notch aligning mechanism 16 is located for aligning notches provided the respective peripheries of the wafers, in one direction, in order to match their crystal orientations with one another. The notch aligning mechanism 16 is provided to face the loading area Sb and configured to align the notches of the respective wafers to be transferred from each carrier 3 on the loading stage 12 by a loading mechanism 24 as will be described below.

At an upper portion on the back side of the loading area Sb, a vertical-type heating furnace 5 having a furnace port 5*a* at its bottom portion as described above is located. In the loading area Sb, a lifting mechanism 18 is provided. The lifting mechanism 18 is configured to raise and lower the cover 17 for opening and closing the furnace port 5*a*, so as to carry in and carry out each boat 4 made from quartz, relative to the heating furnace 5, while the boat 4 is placed on a top portion of the cover 17 via the heat insulating mount 19. In the boat 4, multiple sheets (for example, about 100 to 150 sheets) of wafers W are loaded, in a multistage fashion, in the vertical direction, with a predetermined interval. On the top portion of the cover 17, as described above, the heat insulating mount (heat blocking member) 19 is placed for suppressing heat radiation from the furnace port 5*a* to be generated upon closing the port 5*a* with the cover 17. The boat 4 is placed on the top portion of the heat insulating mount 19. The heating furnace 5 mainly comprises a reaction vessel and a heating unit (heater) provided around the reaction vessel. To the reaction vessel, a gas introducing system adapted to introduce a processing gas and/or inert gas (e.g., N2) into the reaction vessel and an exhaust system including a vacuum pump, which can evacuate the interior of the reaction vessel to a predetermined degree of vacuum, are connected, respectively.

The rotating mechanism 20 adapted to rotate each boat 4 via the heat insulating mount 19 is provided to the cover 17. Around the furnace port 5*a*, a shutter 21 is provided, such that it can be moved (or pivoted) in the horizontal direction so as to open and close the port 5*a*. The shutter 21 serves to shut off the furnace port 5*a* upon carrying out the boat 4 having been subjected to the heating process after the cover 17 has been opened. The shutter 21 includes a shutter driving mechanism (not shown) adapted to turn it in the horizontal direction so as to open and close the furnace port 5*a*.

On one side, i.e., on the side of the fan filter unit 14, of the loading area Sb, a boat table (also referred to as a boat stage or substrate holding tool table) 22 is provided for supporting the boat 4 thereon in order to prepare the transfer of the wafers W. While the boat table 22 may be a single unit, it is preferred that the table 22 is comprises two stages, i.e., a first table (or charge stage) 22*a* and a second table (or standby stage) 22*b*, which are arranged front and back, along the fan filter unit 14, as shown in FIG. 2.

At a lower portion of the loading area Sb and between the loading stage 12 and the heating furnace 5, a boat carrier mechanism 23 is provided, which is adapted for carrying the boat 4, between the boat table 22 and the heat insulating mount 19 on the cover 17, more specifically, between the first table 22*a* or second table 22*b* of the boat table 22 and the heating insulating mould 19 on the cover 17 which in a lowered state, and between the first table 22*a* and the second table 22*b*. Above the boat carrier mechanism 23, the loading mechanism 24 is provided, which is adapted for loading the wafers W, between each carrier 3 on the loading stage 12 and the boat 4 on the boat table 22, more specifically, between the carrier 3 on the loading stage 12 and the notch aligning mechanism 16, between the notch aligning mechanism 16 and the boat 4 on the first table 22*a* of the boat table 22, and between the boat 4 after subjected to the heating process on the first table 22*a* and the vacant carrier 3 on the loading stage 12.

Each boat 4, as shown in FIG. 3, includes a top plate 4*a*, a bottom plate 4*b*, and a plurality of, for example, three, struts 4*c* each provided between the top plate 4*a* and the bottom plate 4*b*. In each strut 4*c*, as shown in FIG. 4, grooves 4*d*, for holding the wafers, in a multistage fashion, are formed, like a comb, with a predetermined pitch. Two, left and right, struts 4*c*, located on the front face side, are positioned to define a slightly wider space, in order to facilitate putting in and taking out each wafer through the so-provided space.

The boat carrier mechanism 23 includes arms, which are adapted to support the single boat 4 in the vertical direction and can be extended in the horizontal direction. Specifically, the boat carrier mechanism 23 includes a first arm 23*a*, which can be pivoted in the horizontal direction and can be moved in the vertical direction, and a flat and generally U-shaped second arm 23*b*, which is supported to be optionally pivoted in the horizontal direction at a distal portion of the first arm 23*a* and is configured to support the bottom face of the boat 4 (i.e., the bottom face of the bottom plate 4*b*), a driving unit 23*c* for driving both of the first arm 23*a* and second arm 23*b*, and a lifting mechanism 23*d* adapted to raise and lower all of these members. In such a configuration, synchronization of the horizontally pivotal movements of the first arm 23*a* and second arm 23*b* enables each boat to be carried in a horizontally linear direction. Due to such expansion and contraction of the arms, the area in which the boat 4 is to be carried can be minimized, thereby reducing the width and length of the apparatus.

The loading mechanism 24 includes a horizontally movable base 24*a*, and multiple sheets, for example, five sheets, of thin-plate like loading arms 24*b* provided on the base 24*a*. Each of the loading arms 24*b* is used for placing a semiconductor wafer thereon and configured to be optionally advanced and retracted relative to the base 24*a*. Among the five loading arms 24*b*, it is preferred that the central one sheet-feeding type loading arm can be moved front and back, independently of the other four loading arms above the base 24, while the pitch between the other four loading arms can be changed in the vertical direction on the basis of the central loading arm. The base 24*a* can also be moved in the vertical direction by actuation of a lifting mechanism 24*c* provided on the other side of the loading area Sb.

In order to prevent the falling-down of the boat 4 placed on the heat insulating mount 19 due to external force, such as an earthquake or the like, hooks 25 (locking parts) are provided at the bottom plate 4*b* of each boat 4, while locking grooves (parts to be locked) 26 to be respectively locked or engaged with the locking parts 25 are provided to an upper portion of the heat insulating mount 19. As shown in FIGS. 5 to 9, the boat 4 and the heat insulating mount 19 can be engaged with and disengaged from each other, by rotating the heat insulating mount 19, over a predetermined angle, for example, 90 degrees, by the rotating mechanism 20, while the boat 4 is positioned just above the heat insulating mount 19, by using the boat carrier mechanism 23.

As shown in FIGS. 3 to 5, each boat 4 has the bottom plate 4*b* having an annular shape, and the heat insulating mount 19 has a plurality of, for example, four, columns 19*a* each adapted to support the bottom face of the bottom plate 4*b*, along the circumferential direction, with an appropriate interval. More specifically, the heat insulating mount 19 includes a disk-like base 19*b*, the plurality of columns 19*a* extending upward from the base 19*b*, and multiple sheets of heat shut off plates 19*c* arranged in a multistage fashion, with an appropriate space, via each spacer 19*j*, in the vertical direction, along the columns 19*a*. These components are formed from, for example, quartz. Each column 19*a* is of a cylindrical shape, and is provided with a top end member 19*e* integrally formed with the column and closing its opening end. In order to prevent damage or breakage of the columns 19*a* due to the difference between the internal and external pressures, holes 19*f* are provided appropriately in the side face of each column 19*a*, for communication of the internal space of the column with the exterior. At a top end of each column 19*a*, or in each top end member 19*e*, a mounting face 19*g*, on which the bottom face of the bottom plate 4*b* of each boat 4 is supported, and a positioning part 19*h* extending upward from the mounting face 19*g* and adapted to contact with the inner circumference of the bottom plate 4*b* so as to position the bottom plate 4*b* are provided. In order to facilitate fitting or engagement of each positioning part 19*h* relative to the inner circumference of the bottom plate 4*b*, it is preferred that an inclined face 19*i* is formed in a top end edge of the positioning part 19*h*.

In addition, for supporting the annular bottom plate 4*b* of the boat 4, the diameter of a circle to be circumscribed on the respective columns 19*a* arranged, with an appropriate space, inwardly along the circumferential direction of the bottom plate 4*b* is designed to be smaller than the outer diameter of the bottom plate 4*b*. Hence, the second arm 23*b* of the boat carrier mechanism 23 will never interfere with the columns 19*a*, upon placing the boat 4 on the top end of each column 19*a* of the heating insulating mould 19 while supporting the bottom face of the bottom plate 4*b* of the boat 4. As shown in FIGS. 5 to 8, the locking groove 26 is formed, as the part to be locked, in an outer side face of each column 19*a*, while the hook 25 having an L-shaped cross section is provided, as the locking part configured to be locked or engaged with each locking groove 26, to the bottom face of the bottom plate 4*b*, at a position corresponding to each locking groove 26.

Each hook 25 includes a vertical part 25*a* extending downward from the bottom face of the bottom plate 4*b* and a horizontal part 25*b* projecting radially inward from a bottom end of the vertical part 25*a*. Each locking groove 26 is configured such that the horizontal part 25*b* of each corresponding hook 25 can enter externally the locking groove 26, when the heat insulating mount 19 is rotated by a predetermined angle in the horizontal direction by the rotating mechanism 20, while the boat 4 is carried and held just above the heat insulating mount 19 by the boat carrier mechanism 23. It should be appreciated that the locking groove 26 is designed to have a width and a depth that will not interfere with the insertion of the horizontal part 25*b* of each corresponding hook 25 into each corresponding groove 26. In this case, after the rotation of the heat insulating mount 19 is stopped in a position allowing for the locking between each hook 25 and each corresponding locking groove 26, the boat 4 is placed on the columns 19*a* of the heat insulating mount 19, by further lowering the boat 4 by the actuation of the boat carrier mechanism 23. At this time, it is preferred that the width of each locking groove 26 is designed to avoid the contact between the locking groove 26 and the horizontal part 25*b* of each corresponding hook 25, because such a design can control or prevent occurrence of undesired particles (see FIG. 6). It is also preferred that the distal end of each horizontal part 25*b* and the bottom face of each locking groove 26 are each formed into a curved face centered at the center of rotation of the heat insulating mount 19.

Figure 10:
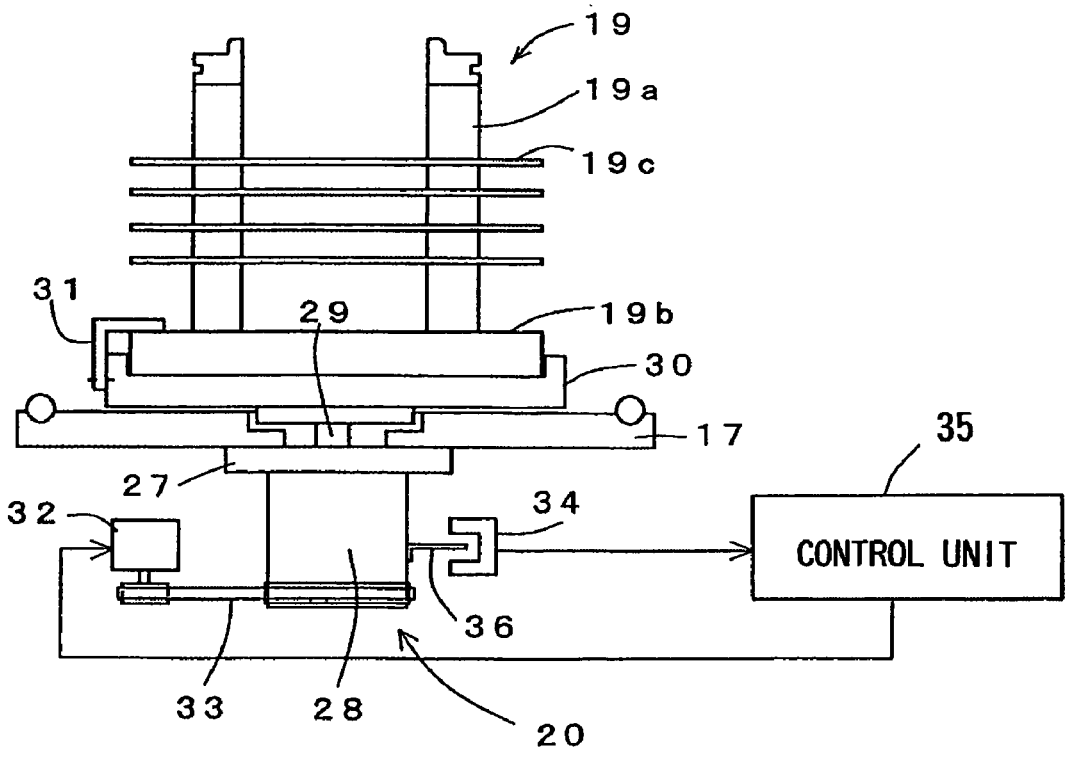
FIG. 10 is a view schematically showing a rotating mechanism of the heat insulating mount.

As the rotating mechanism 20, the one described, for example, in TOKKYO No. 3579278, KOHO, can be applied. Namely, as shown in FIG. 10, a fixing member 27 having an axial hole is provided at a bottom portion of the cover 17. Around the fixing member 27, a rotary cylinder 28 having a cylindrical shape with a bottom portion is provided rotatably via a bearing or magnetic fluid seal (not shown) extending in the vertical direction. To the rotary cylinder 28, a rotation shaft 29 is provided to be freely inserted through the axial hole of the fixing member 27. An upper end portion of the rotation shaft 29 extends freely through a central portion of the cover 17, and a rotary table 30 is attached to the upper end portion of the rotation shaft 29. The rotary table 30 is located to define a gap relative to the top face of the cover 17, and the heat insulating mount 19 is placed on the rotary table 30, wherein the base 19*b* of the heat insulating mount 19 is fixed to the rotary table via a fixing member 31. To the rotary cylinder 28, a motor 32 for rotating the cylinder 28 is connected via a timing belt 33.

In order to automatically control the rotation of the heat insulating mount 19 to take a position in which each hook 25 and each corresponding locking groove 26 can be engaged with or disengaged from each other, it is preferred that the rotating mechanism 20 includes a sensor 34 for detecting a point of the origin in the rotating direction of the heat insulating mount 19, and a control unit 35 for controlling the rotation of the heat insulating mount 19, such that the heat insulating mount 19 can be in a position for enabling the engagement or in a position for enabling the disengagement, between the hooks 25 and locking grooves 26, based on a signal to be detected from the sensor 34. At an outer circumferential portion of the rotary cylinder 28, a member to be detected (or kicker) 36 projects outward, and the sensor 34 for detecting the member 36 is located below the cover 17. The control unit 35 is programmed to control the boat 4 to be rotated continuously via the heat insulating cylinder 19.

In order to prevent the falling-down of each boat 4 due to an external force, such as an earthquake or the like, during the transfer of the boat 4 to be carried by the boat carrier mechanism 23, it is preferred that a fall-down controlling member 37 is provided at a top portion of the second arm 23*b*, as shown in FIG. 4, the fall-down controlling member 37 being configured to hold the bottom plate 4*b* of the boat 4 from above and below between the member 37 and second arm 23*b*. As shown in FIG. 4, the fall-down controlling member 37 is located on the side of a base portion of the second arm 23*b*, and includes a pair of controlling pieces 37*a* extending over the top face of the bottom plate 4*b* of the boat 4, while being opposed to each other defining a predetermined space therebetween.

Figure 11:
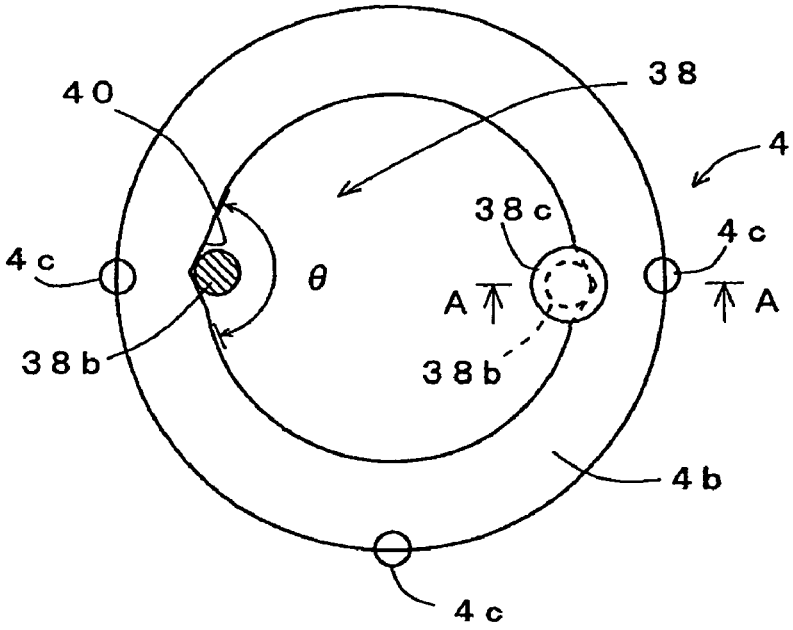
FIG. 11 is a plan view schematically showing a positioning mechanism of the wafer boat on a boat table.
Figure 12:
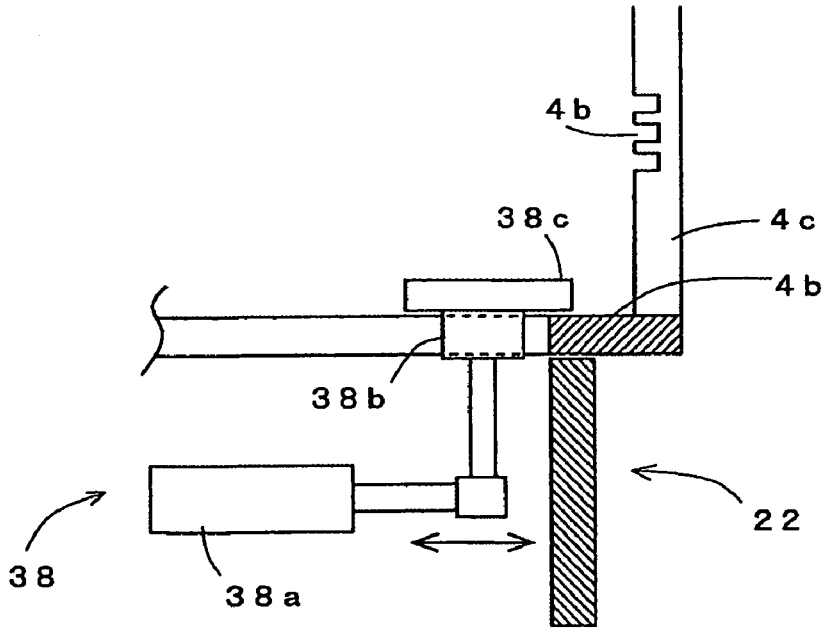
FIG. 12 is an enlarged cross section taken along line A-A of FIG. 11.

Moreover, the following construction is employed, in order to prevent the falling-down of each boat 4 placed on the boat table 22 due to an external force, such as an earthquake or the like. Namely, as shown in FIGS. 2, 11 and 12, a positioning mechanism 38 for positioning each boat 4 is provided to the boat table 22. The positioning mechanism 38 includes a pair of pins 38*b*, which can be moved relatively to be closer to and spaced away from each other in the diametrical direction, on the boat table 22, by actuation of a cylinder 38*a*. On the other hand, in the inner circumference of the bottom plate 4*b* of the boat 4, V-shaped engaging grooves 40 are provided to be opposed, diametrically inward, to the pair of pins 38*b*, each engaging groove 40 being configured to be engaged with each pin 38*b* when the pins 38 are spread or spaced away from each other. Each engaging groove 40 is opened to define a predetermined angle θ, for example 120 degrees. Thus, even though the boat 4 is placed on the boat table 22 while being slightly shifted from a proper position, the boat 4 can be repositioned correctly due to such a construction. Additionally, a disk-like falling-down controlling part 38*c* is provided on each pin 38*b* such that the controlling part 38*c* can extend over and along the top face of the bottom plate 4*b* of the boat 4 upon the engagement of the pin 38*b* with the corresponding engaging groove 40. Accordingly, the falling-down of the boat 4 can be securely prevented, by holding the bottom plate 4*b* of the boat 4, from above and below, between the falling-down controlling part 38*c* and the top face of the boat table 22 upon the engagement of each pin 38*b* with each engaging groove 40.

Next, the operation of the vertical type heat processing apparatus 1 constructed as described above and a vertical type heating method will be described. First, one of the boats 4 holding the multiple sheets of wafers W therein and placed on the cover 17 via the heat insulating mount 19 is carried into the heating furnace 5 together with the heat insulating mount 19 by the elevation of the cover 17, and the furnace port 5*a* of the heating furnace 5 is then closed by the cover 17. Thereafter, the wafers W are subjected to a heating process for a predetermined period of time, at a predetermined temperature, under a predetermined pressure and in a predetermined gas atmosphere, while the boat 4 is rotated in the heating furnace 5 via the heat insulating mount 19 by the rotating mechanism 20. During the heating process, the loading of wafers W onto the other boat 4 placed on the first table 22*a* of the boat table 22 is carried out. In this case, first wafers W, having been subjected to the previous heating process loaded on the other boat 4, are carried into a vacant carrier 3 placed on the loading stage 12 due to the loading mechanism 24. Thereafter, unprocessed wafers W are transferred onto the other vacant boat 4 from another carrier 3, which stores unprocessed wafers W therein and is to be carried next onto the loading stage 12.

Once the heating process in the heating furnace 5 is completed, the cover 17 is lowered so as to carry out the boat 4 from the heating furnace 5 into the loading area Sb. Subsequently, the first arm 23*a* of the boat carrier mechanism 23 approaches the boat 4 from below (see FIG. 6) and then raises the boat 4 a predetermined level (see FIG. 7). In this state, each hook 25 and the corresponding locking groove 26 come in positions respectively for enabling disengagement therebetween, by rotating the heat insulating mount 19, over 90 degrees, for example, by the rotating mechanism 20 (see FIG. 8). The boat 4 is further raised up to a higher predetermined level (at which each hook will not interfere with each column of the heat insulating mount), so that the boat 4 can be carried toward the second table 22*b* of the boat table 22 (see FIG. 9). In this way, the boat 4 can be placed on the second table 22*b*. Thereafter, the boat 4 placed on the second table 22*b* is positioned by the positioning mechanism 38, so that the falling-down of the boat 4 can be prevented by the disk-like falling-down controlling part 38*c*.

On the other hand, the boat 4 placed on the first table 22*a*, after released from the positional control due to the falling-down controlling part 38*c*, is carried to a position over the heat insulating mount 19 on the cover 17, while being supported by the second arm 23*b* of the boat carrier mechanism 23. This boat 4 is then lowered onto the heat insulating mount 19 by the boat carrier mechanism 23, and the heat insulating mount 19 is rotated a predetermined angle, for example, 90 degrees, by the rotating mechanism 20, just prior to the mounting of the boat 4 on the heat insulating mount 19. Thus, each hook 25 can be locked with each corresponding locking groove 26. Thereafter, the boat 4 can be mounted on the heat insulating mount 19 by further lowering the boat 4. In this manner, once the boat 4 is mounted on the heat insulating mount 19, the boat 4 can be carried into the heating furnace 5 by the elevation of the cover 17 so as to start the heating process. During the heating process, the other boat 4 having been placed on the second table 22*b* is carried onto the first table 22*a* by the boat carrier mechanism 23. As such, on the first table 22*a*, both of the transfer work for the wafers W having been subjected to the heating process from the boat 4 into the carrier 3 placed on the loading stage 12 and the loading work for the unprocessed wafers W onto the boat 4 from the carrier 3 placed on the loading stage 12, due to the loading mechanism 24, can be performed, thereby enhancing the throughput.

As described above, according to the vertical type heat processing apparatus 1 of this embodiment, the hooks 25 and the locking grooves 26 are provided at the bottom portion of the boat 4 and at the upper portion of the heat insulating mount 19, respectively, such that each hook 25 and the corresponding locking groove 26 can be locked with and disengaged from each other, by rotating the heat insulating mount 19 a predetermined angle by the rotating mechanism 20 while the boat 4 is positioned just above the heat insulating mount 19 due to the boat carrier mechanism 23. Therefore, the vertical type heat processing apparatus 1 of this embodiment can prevent the falling-down of the boat 4 placed on the heat insulating mount 19 due to an external force, such as an earthquake, by employing a simple structure, while taking a form of the so-called two-boat system. Additionally, according to the vertical type heating method of this invention, the boat 4 is mounted on the heat insulating mount 19 by further lowering the boat 4, after the following steps. First, the boat 4 is lowered toward the heat insulating mount 19 by the carrier mechanism 23, and then each hook 25 and corresponding groove 26 are brought into a state that they can be locked with each other, by rotating the heat insulating mount 19 a predetermined angle by the rotating mechanism 20 just prior to the mounting of the boat 4 on the heat insulating mount 19. Accordingly, the apparatus of this embodiment can securely prevent the falling-down of the boat 4 placed on the heat insulating mount 19 due to an external force, such as an earthquake, by employing a simple structure, while taking a form of the so-called two-boat system.

In this case, each boat 4 includes an annular bottom plate 4*b*, and the heat insulating mount 19 includes the plurality of columns 19*a* for supporting the bottom face of the bottom plate 4*b* along its circumferential direction with an appropriate space. Each locking groove (i.e., the groove-like portion to be locked) 26 is provided in the outer side face of each column 19*a*, and the hooks (i.e., the L-shaped locking portions) 25 are provided to the bottom face of the bottom plate 4*b*, such that each hook 25 can be optionally locked with each corresponding locking groove 26. Thus, both of the locking and releasing between the heat insulating mount 19 and the boat 4 can be ensured and facilitated by employing such a simple structure.

The rotating mechanism 20 includes the sensor 34 for detecting a point of the origin in the rotating direction of the heat insulating mount 19, and the control unit 35 for controlling the rotation of the heat insulating mount 19 to be in the position for enabling the engagement or in the position for enabling the disengagement, between the hooks 25 and locking grooves 26 based on the signal to be detected from the sensor 34. Thus, the engagement and disengagement between the heat insulating mount 19 and the boat 4 can be further ensured and facilitated.

Figure 13:
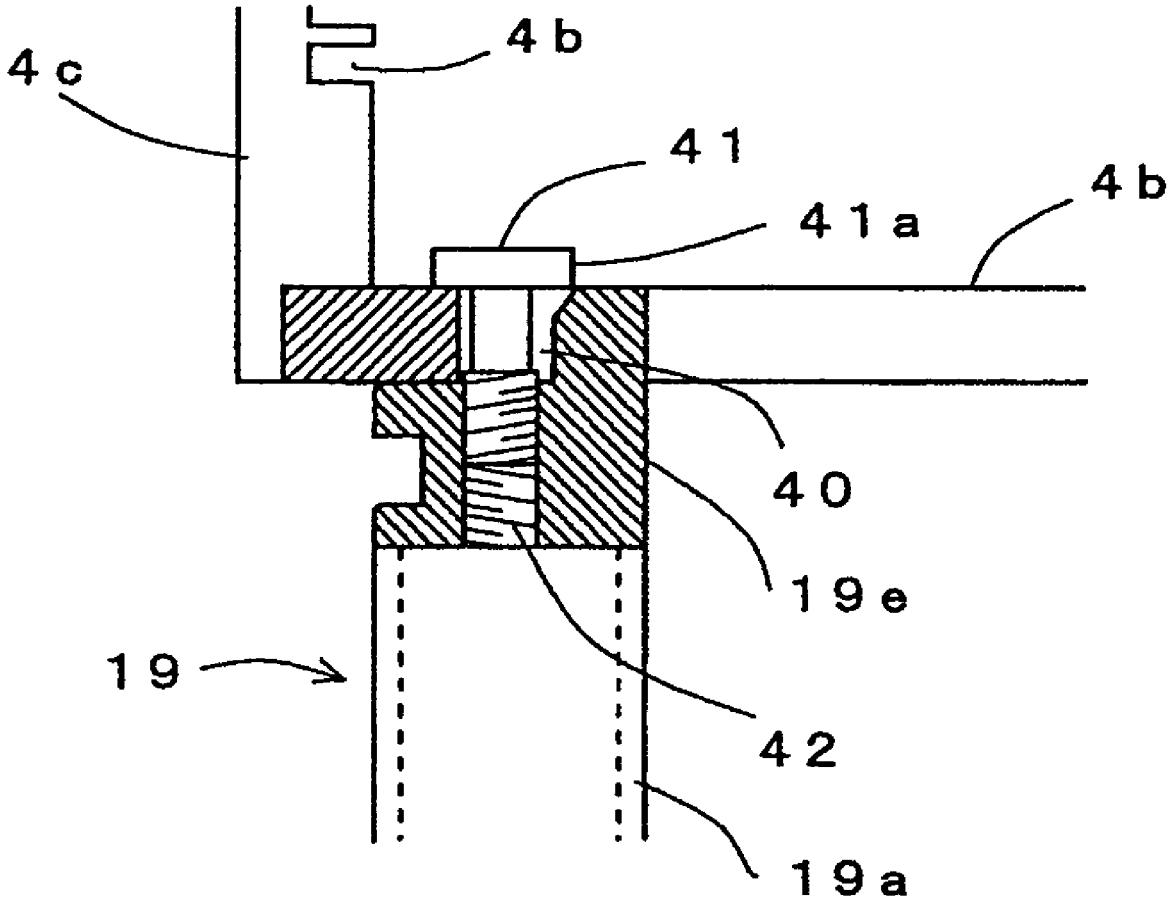
FIG. 13 is an enlarged cross section of a key portion, showing an alternative of the heat insulating mount.

FIG. 13 is an enlarged cross section of a key portion, showing an alternative of the heat insulating mount. In the heat insulating mount 19 of the alternative embodiment shown in FIG. 13, a female screw hole 42 is provided in the top end member 19*e* of each column 19*a*, and the female screw hole 42 is adapted for fixing the bottom plate 4*b* of the boat 4 to the top end member 19*e*, by using an attaching screw 41. Each attaching screw 41 is fixedly engaged with the female screw hole 42 after passing through each V-shaped engaging groove 40 of the bottom plate 4*b*. Thus a head 41*a* of the attaching screw 41 is fastened against the top face of the bottom plate 4*b*, thereby fixing the bottom plate 4*b* onto each column 19*a*. According to this heat insulating mount 19, the entire system can be utilized as the one-boat system by fixing the heat insulating mount 19 to the boat 4 by attaching the screws 41. Otherwise, it can also be utilized as the two-boat system if removing the attaching screws 41.

Figure 14:
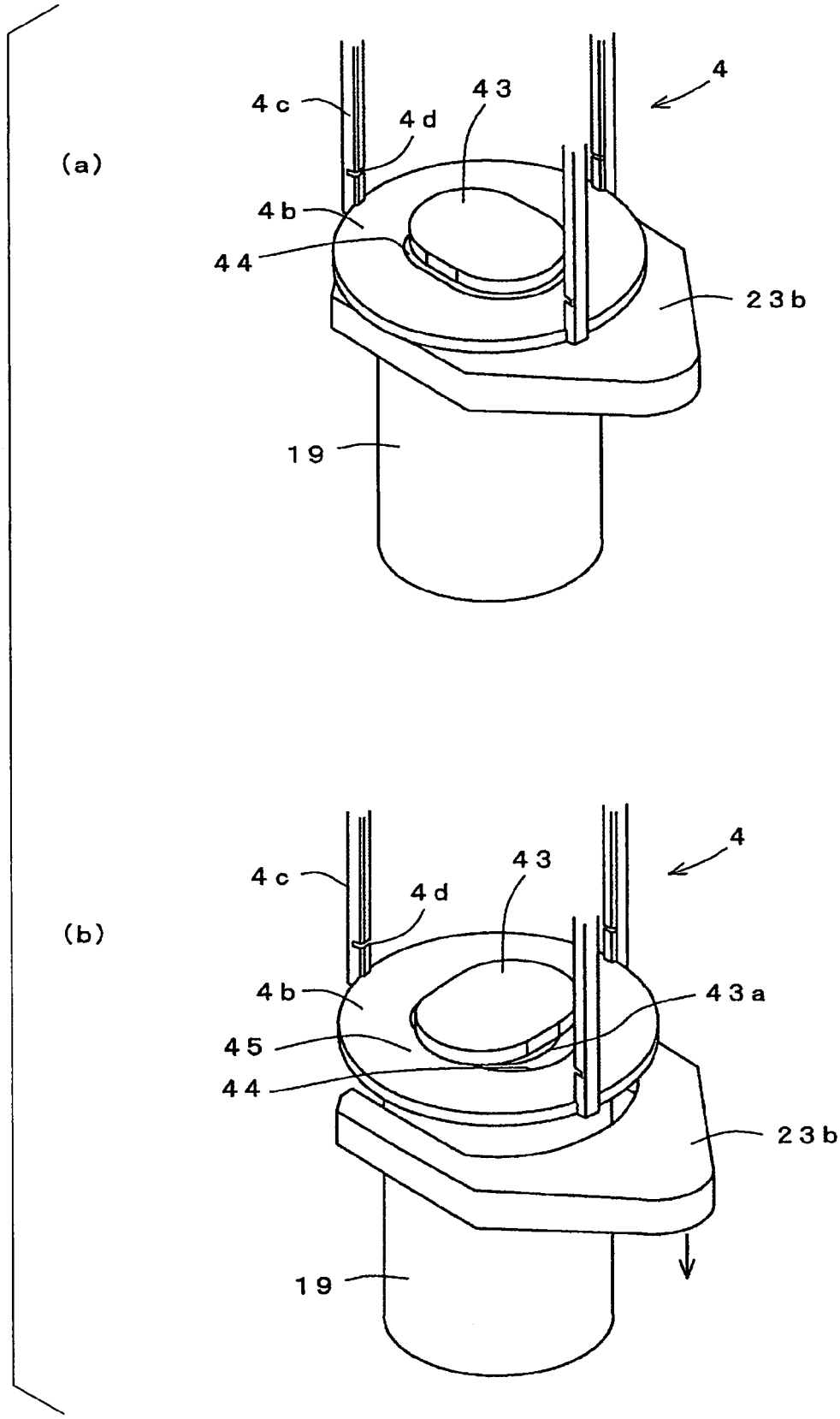
FIGS. 14(*a*) and 14(*b*) respectively show another aspect for locking the heat insulating mount and the wafer boat to each other, FIG. 14(*a*) illustrating an unlockable state, while FIG. 14(*b*) illustrating a lockable state.

FIG. 14 is a view showing another construction for locking or engaging the heat insulating mount and the wafer boat with each other, wherein FIG. 14(*a*) illustrates an unlockable state, while FIG. 14(*b*) illustrates a lockable state. As shown in the drawings, the heat insulating mount 19 includes an elliptic-plate-like latch key 43 projecting upward at a central portion of a top end and extending in the lateral direction, and the boat 4 has the bottom plate 4*b* suitable to be placed on such a top end of the heat insulating mount 19. Namely, a latch key hole 44, through which the latch key 43 can extend, is formed in the bottom plate 4*b*, whereby the latch key 43 and the top face (i.e., the part to be locked) 45 of the bottom plate 4*b* opposed to the latch key 43 can be locked with each other, by rotating the latch key 43 having passed through the latch key hole 44, together with the heat insulating mount 19, over a predetermined angle, for example, 90 degrees.

The top end of the cylindrical heat insulating mount 19 is closed, and the latch key 43 is integrally formed at the central portion of the top end of the heat insulating mount 19 via a shaft 43*a* having a circular cross section. The length of the major axis of the latch key 43 is designed smaller than the diameter of the heat insulating mount 19 but greater than the diameter of the shaft 43*a*, while the length of the minor axis of the latch key 43 is sized to be substantially equal to the diameter of the shaft 43*a*. It is preferred that V-shaped engaging grooves (not shown) for positioning the boat 4 and the heat insulating mount 19 are provided in the inner circumference of the latch key hole 44 formed in the bottom plated 4*b* of the boat 4, as with the previous embodiment.

In the case of placing the boat 4 on the heat insulating mount 19, the boat 4 is carried above the heat insulating mount 19 placed on the cover 17, while the bottom face of the bottom plate 4*b* of the boat 4 is supported by the second arm 23*b* of the boat carrier mechanism 23. Subsequently, the boat 4 is lowered, and the latch key 43 is inserted through the latch key hole 44 formed in the bottom plate 4*b*. The latch key 43 and the top face 45 of the bottom plate 4*b* are then brought into a position in which they can be engaged with each other, by rotating the heat insulating mount 19 a predetermined angle, for example, 90 degrees, by the rotating mechanism 20, just prior to the mounting of the boat 4 onto the heat insulating mount 19. Thereafter, the boat 4 can be mounted on the heat insulating mount 19 by further lowering the boat 4. Consequently, the falling-down of the boat 4 placed on the heat insulating mount 19 can be prevented, thus successfully avoiding damage or breakage of the boat 4 and wafers W.

While the embodiments of the present invention have been described with reference to the drawings, this invention is not limited to these embodiments, but various modifications can be made without departing from the spirit and scope of this invention.

The invention claimed is:

1. A vertical type heat processing apparatus, comprising:

a heating furnace having a furnace port formed at a bottom portion thereof;

a pair of substrate holding tools, each adapted to hold multiple substrates and configured to be carried into the heating furnace so as to perform a heating process to the substrates;

a cover adapted to close the furnace port of the heating furnace;

a heat insulating mount provided on the cover;

a rotating mechanism provided to the cover and adapted to rotate the cover and the heat insulating mount;

a lifting mechanism adapted to raise and lower the cover;

a table provided adjacent to a position just below the heating furnace; and a carrier mechanism adapted to carry each of the pair of substrate holding tools between a position on the heat insulating mount and a position on the table, wherein a locking part is provided to either one of each substrate holding tool and the heat insulating mount, and a part to be locked is provided to the other thereof, such that the locking part and the part to be locked can be engaged with and disengaged from each other, by rotating the heat insulating mount due to the rotating mechanism, while each substrate holding tool is held just above the heat insulating mount due to the carrier mechanism.

2. The vertical type heat processing apparatus according to claim 1, wherein each substrate holding tool has an annular bottom plate, and the heat insulating mount includes a plurality of columns with an appropriate interval, each adapted to support a bottom face of the bottom plate, along its circumferential direction, and wherein the part to be locked is formed in an outer side face of each column so as to have a groove-like shape, and the locking part is formed at the bottom face of the bottom plate so as to be of an L-shape, such that the locking part can be engaged with each part to be locked.

3. The vertical type heat processing apparatus according to claim 1, wherein the rotating mechanism includes a sensor for detecting a point of the origin in the rotating direction of the heat insulating mount, and a control unit for controlling the rotation of the heat insulating mount such that the heat insulating mount will be in a position for enabling the engagement or in a position for enabling the disengagement, between each locking part and each part to be locked, based on a signal to be detected from the sensor.

4. The vertical type heat processing apparatus according to claim 1, wherein the locking part is provided to the heat insulating mount, the locking part having an elliptic-plate-like shape projecting upward from a central portion of a top end of the heat insulating mount and extending in the lateral direction, and wherein each substrate holding tool has a bottom plate capable of being mounted on the top end of the heat insulating mount, and a key hole, through which the locking part can be inserted, is formed in the bottom plate, such that the top face of the bottom plate opposed to the locking part can serve as the part to be locked, thereby to be engaged with the locking part, by rotating the locking part having been inserted through the key hole, over a predetermined angle, together with the heat insulating mount.

5. The vertical type heat processing apparatus according to claim 1, wherein each substrate holding tool has an annular bottom plate, and the heat insulating mount has a plurality of columns with an appropriate interval, each adapted to support the bottom face of the bottom plate, along the circumferential direction, and wherein the part to be locked is composed of a female screw hole formed in an upper portion of each column, and the locking part is composed of an attaching screw configured to be inserted in the female screw hole from the bottom plate and fixedly engaged with the female screw.

6. A vertical type heating method, comprising the steps of:

placing one substrate holding tool holding multiple substrates, on a cover adapted to close a furnace port of a heating furnace, via a heat insulating mount;

carrying the one substrate holding tool into the heating furnace, by elevating the cover by a lifting mechanism;

performing a heating process to the substrates in the heating furnace while rotating the cover, the heat insulating mount and the substrate holding tool, by a rotating mechanism, as well as loading substrates onto the other substrate holding tool placed on a table; and carrying the one substrate holding tool from a position on the heat insulating mount onto the table while carrying the other substrate holding tool from a position on the table onto the heat insulating mount, wherein a locking part is provided to either one of each substrate holding tool and the heat insulating mount, while a part to be locked is provided to the other thereof, such that the locking part and the part to be locked can be engaged with each other, by rotating the heat insulating mount by the rotating mechanism, while the other substrate holding tool is held just above the heat insulating mount by a carrier mechanism, and thereafter the other substrate holding tool can be mounted on the heat insulating mount, by further lowering the other substrate holding tool.

7. The vertical type heating method according to claim 6, wherein each substrate holding tool has an annular bottom plate, and the heat insulating mount includes a plurality of columns with an appropriate interval, each adapted to support a bottom face of the bottom plate, along its circumferential direction, and wherein the part to be locked is formed in an outer side face of each column so as to have a groove-like shape, and the locking part is formed at the bottom face of the bottom plate so as to be of an L-shape, such that the locking part can be engaged with each part to be locked.

8. The vertical type heating method according to claim 6, wherein the rotating mechanism includes a sensor for detecting a point of the origin in the rotating direction of the heat insulating mount, and a control unit for controlling the rotation of the heat insulating mount such that the heat insulating mount will be in a position for enabling the engagement or in a position for enabling the disengagement, between each locking part and each part to be locked, based on a signal to be detected from the sensor.

9. The vertical type heating method according to claim 6, wherein the locking part is provided to the heat insulating mount, the locking part having an elliptic-plate-like shape projecting upward from a central portion of a top end of the heat insulating mount and extending in the lateral direction, and wherein each substrate holding tool has a bottom plate capable of being mounted on the top end of the heat insulating mount, and a key hole, through which the locking part can be inserted, is formed in the bottom plate, such that the top face of the bottom plate opposed to the locking part can serve as the part to be locked, thereby to be engaged with the locking part, by rotating the locking part having been inserted through the key hole, over a predetermined angle, together with the heat insulating mount.

* * * * *